United States Patent [19]

Nestlen et al.

[11] Patent Number: 4,623,863

[45] Date of Patent: Nov. 18, 1986

[54] POLARIZED ELECTROMAGNETIC RELAY WITH ANGLED YOKE ARRANGEMENT

[75] Inventors: Wolfgang Nestlen, Rottweil; Arno Reger, Deilingen, both of Fed. Rep. of Germany

[73] Assignee: Hengstler GmbH Geschäftsbereich Haller-Relais, Wehingen, Fed. Rep. of Germany

[21] Appl. No.: 626,932

[22] Filed: Jul. 2, 1984

[30] Foreign Application Priority Data

Jul. 6, 1983 [DE] Fed. Rep. of Germany ..... 3324246

[51] Int. Cl.[4] ..... H01F 7/14

[52] U.S. Cl. ..... 335/230; 335/281

[58] Field of Search ..... 335/229, 230, 234, 272, 335/281

[56] References Cited

U.S. PATENT DOCUMENTS 3,005,071 10/1961 Brunicardi ..... 335/281
3,167,693 1/1965 Hayward ..... 335/281 X
3,198,995 8/1965 Grebe ..... 335/272 X
4,472,699 9/1984 Fujii et al. ..... 335/281

FOREIGN PATENT DOCUMENTS 161362 2/1955 Australia ..... 335/281
744719 2/1956 United Kingdom ..... 335/281

*Primary Examiner*—George Harris
*Attorney, Agent, or Firm*—Paul H. Gallagher

[57] ABSTRACT

The polarized, electromagnetic relay includes a magnet frame, relative to conduit rabbets, with angles-off yoke arrangement, which includes two separated, parallel-arranged yokes, as well as a permanent magnet that lies therebetween and between anchor plates. The two yokes are L-shaped and formed exactly identical, whereby their core shanks stretch over the entire length of the exciter coil, and lie next to each other in the region of the exciter coil. Thereby a mechanically and electrically absolutely symmetrical magnet frame results, whose asymmetry is compensated by losses arising from the air gap. Through the use of individual yokes there ensues a simple assembly in the spring jack, which functions as holding element for all of the parts.

3 Claims, 10 Drawing Figures

POLARIZED ELECTROMAGNETIC RELAY WITH ANGLED YOKE ARRANGEMENT

Figure 1:
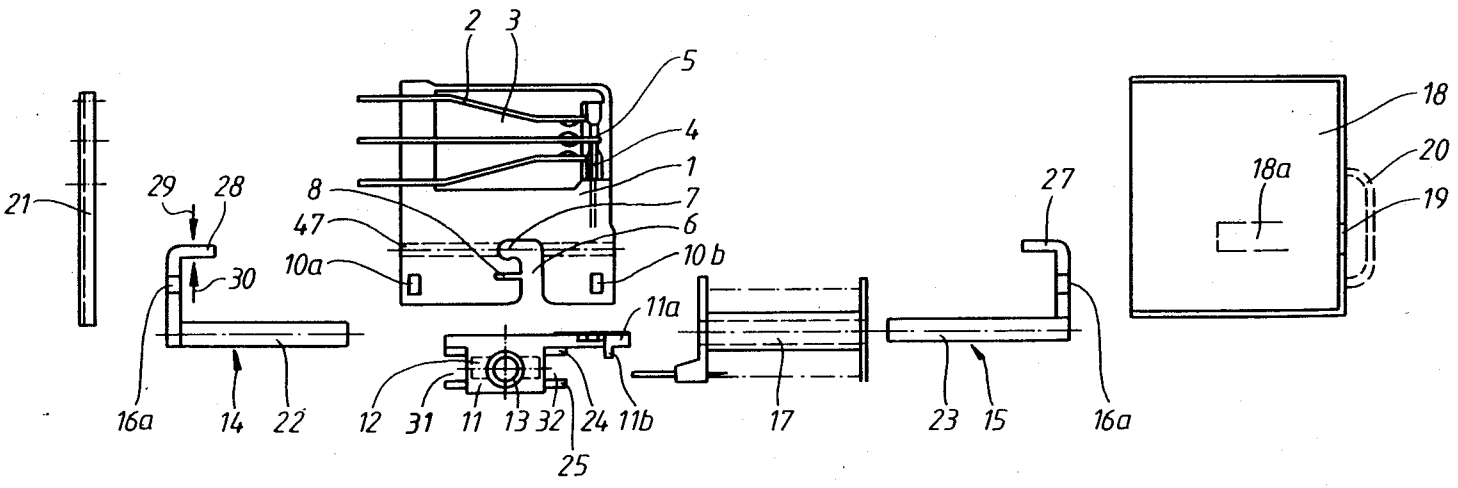

The invention concerns a polarized, electromagnetic relay with an angles-off yoke arrangement, consisting of two separate, parallel-arranged yokes with a permanent magnet arranged between the yokes and between anchor plates, wherein the shanks of this yoke arrangement carry an exciter coil, and the permanent magnet, arranged in an anchor tumbler switch, can be brought with its anchor plates into contact with the pole surfaces of the yoke.

A relay mentioned in the introduction is known for example as a DE-C 966 845 or an EP-A 1-0074577. In both previous production forms, there is the disadvantage that due to the differences between the L-shaped yokes in any one switch, the magnetic circle is unsymmetrical and therefore a relatively large electrical loss results.

A better known feature is fastening the yokes to a core by means of rivets, but notwithstanding that, the same disadvantage arises, that through the riveting process inhomogeneities in the material are caused, which no longer guarantee a symmetrical magnet frame.

The present invention has the purpose to so further build a polarized, electromagnetic relay of the sort mentioned in the introduction, which includes a spring jack that serves as a central holding element for the exciter coil, the yoke, and the tumbler switch, thereby eliminating the disadvantages of an asymmetrical magnet frame in the above mentioned other known constructions, that is, all mechanical tolerances, and all electrical tolerances, relate to the central unity of two yoke core parts, which in themselves are always homogeneous. (That is, in the mathematical sense, the yokes are the zero point, or as the case may be, the coordinate origin. Owing to the fact that the yokes are fed into two conduit rabetts that are in themselves always homogeneous, the mechanical tolerances are cumulative over the tumbler switch, spring jack, passageway, to the contact springs, and the electrical tolerances are cumulative over even both these same identical parts, air gaps, coil bodies, to the casing.)

The present invention is directed to overcoming the foregoing objections, being characterized in that all parts relate constructively and mechanically to the spring jack and are there fastened, which leads to simple production. The spring jack itself is formed as a cost effective synthetic injection die casting part, and has appropriate conduit rabbets, conduit ribs and notch openings. The symmetry of the magnet frame is thereby achieved, in that the two yokes are formed L-shaped and exactly like each other, so that their core shanks extend over the entire length of the exciter coil and lie next to each other throughout their length in the region of the exciter coil.

With the use of a second identical yoke, there is the advantage that the air gap losses in the interior of the coil work symmetrically on both yokes.

The feature that, a yoke with a yoke shank from the one side in the exciter coil, and another similar yoke with a yoke shank from the other side in the exciter coil, join together, and both of these yoke shanks extend over the entire length of the exciter coil, produces the advantage that the air gap losses work exactly symmetrically over both yokes, and hereby the magnetic flux circle is formed exactly symmetrical. Hereby is created an absolutely symmetrical relay that compensates for the symmetry faults of the magnet frame, the relay, especially because of the identical moulding of both the yokes, being easy to mount and to dismantle. The yokes are constructed as cost effective punch parts, whose production need not be worked for great precision, because small non-parallel shapes are thereby eliminated in that the yokes are led exactly into adapted rabbets in the side walls of the spring jack, the rabbets in themselves being always homogeneous, whereby a precise assembly is possible. The parallelism of the sole surfaces of the yoke is therefore effected solely through being conducted in the region of the rabbets in the side walls of the spring jack, whereby at the yokes corresponding conduit surfaces are arranged. Faulty radii or faults of the bending surfaces of the entire yoke are always compensated even if an air gap inside the yoke should occur.

Even a known air gap can be tolerated, which however can be compensated in that it operates over the entire length of the coil. Further characteristics of the invention are the object of the remaining sub-claims.

The object of the present invention doesn't arise solely from the object of the individual patent claims but, rather out of the combination of the individual patent claims together. All of the specifications and characteristics revealed in the documents, especially the spatial development presented in the drawings, are claimed as essential to the invention, insofar as they are single or in combination new respective to the state of technics.

In the following the invention is more closely illustrated solely by means of a drawing that presents a construction form. Derived from the drawings and their description are further characteristics and advantages essential to the invention.

Figure 2:
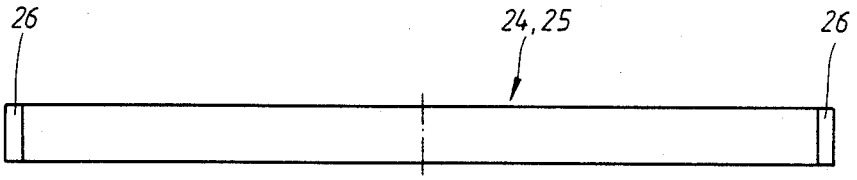
Figure 3:
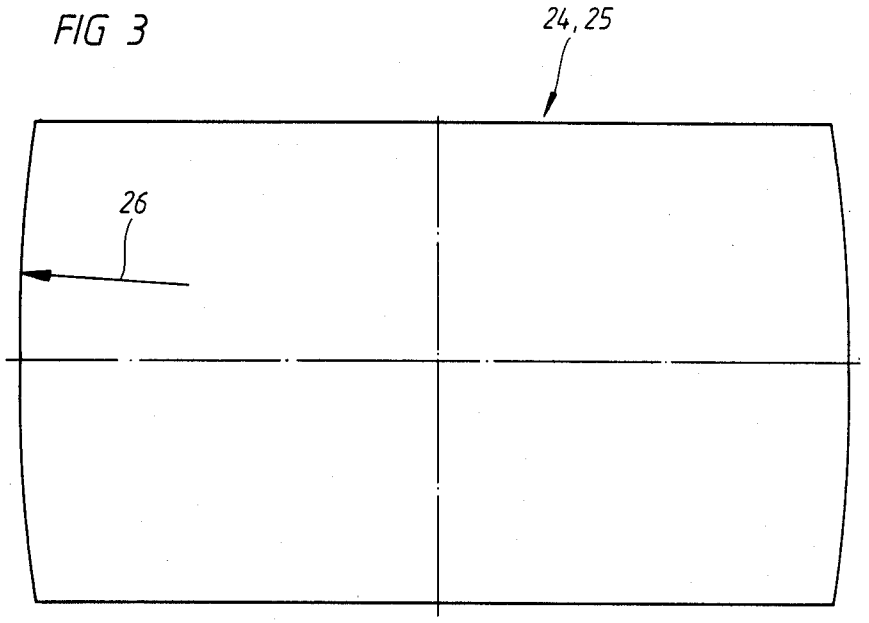
Figure 4:
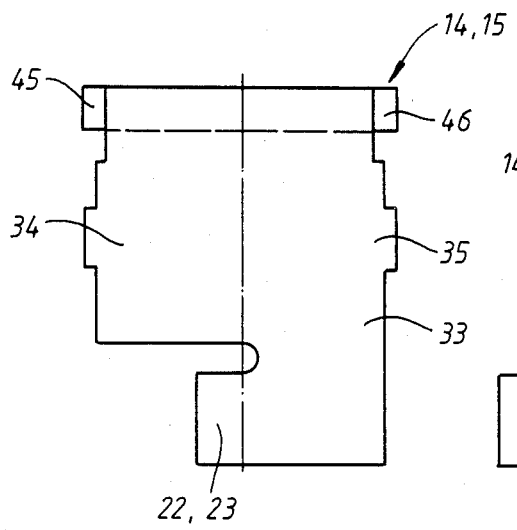
Figure 5:
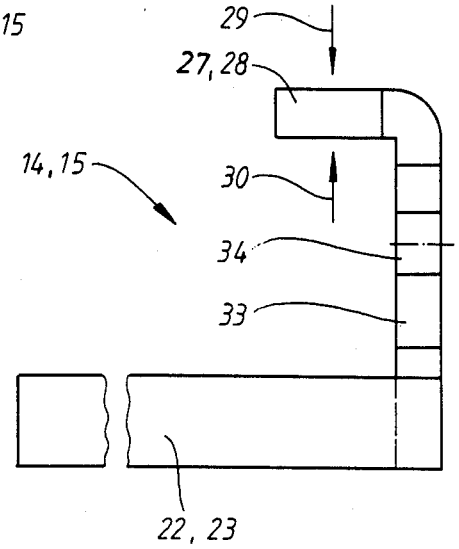
Figure 6:
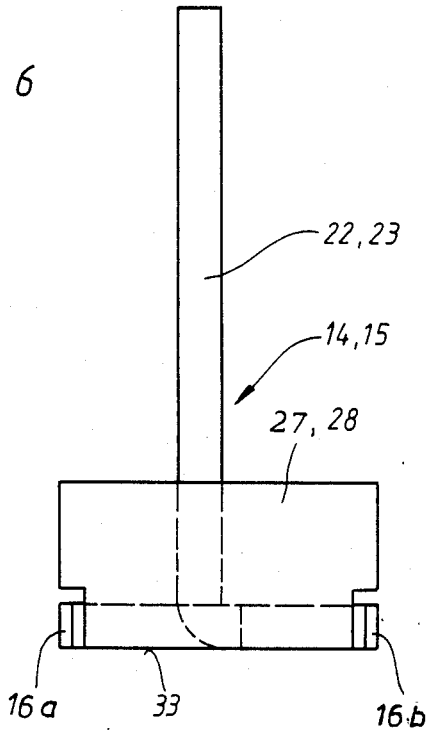
Figure 8:
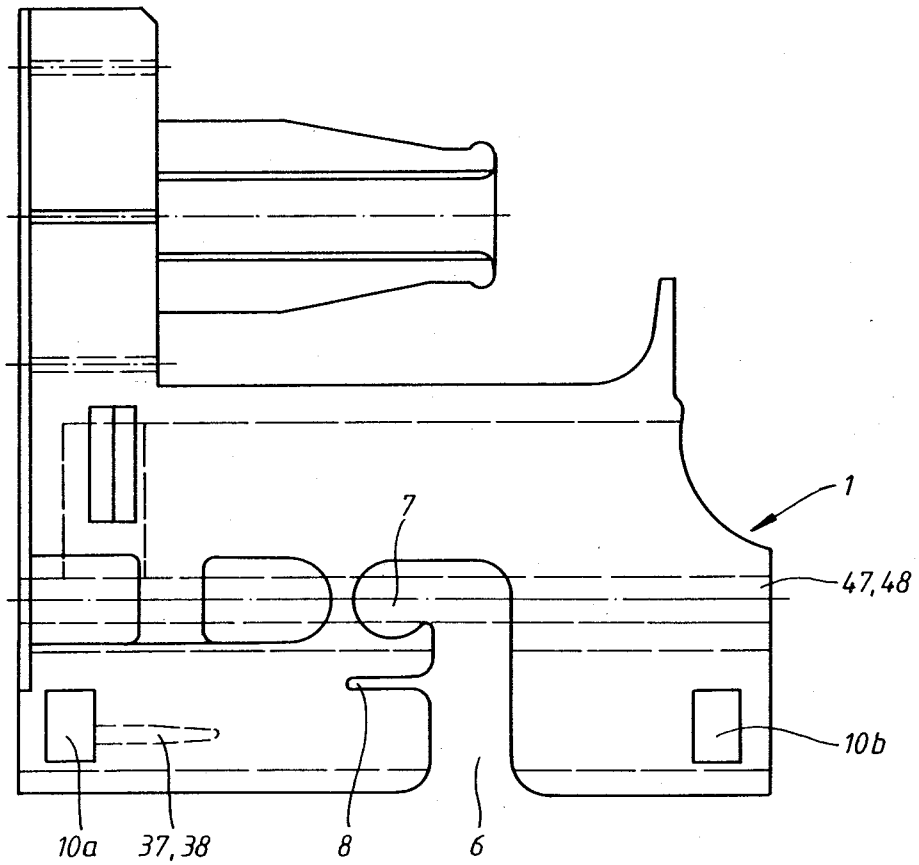
Figure 7:
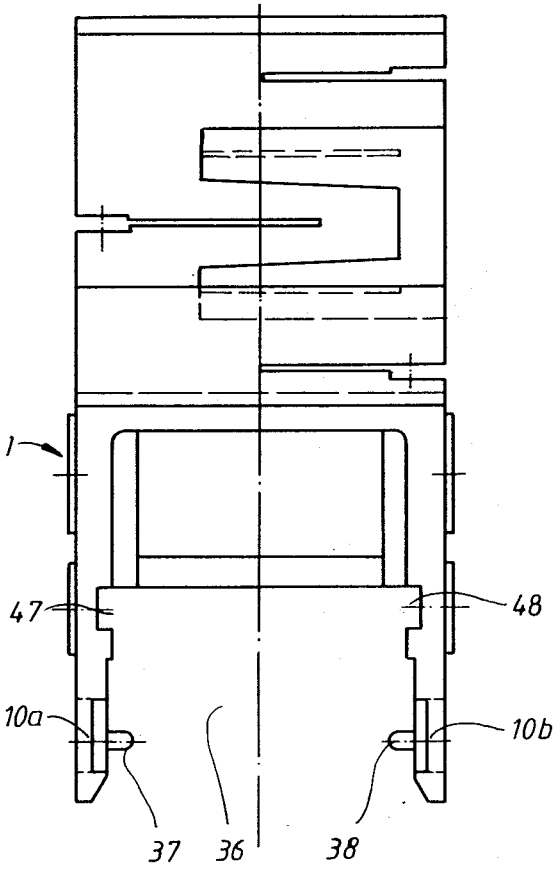
Figure 9:
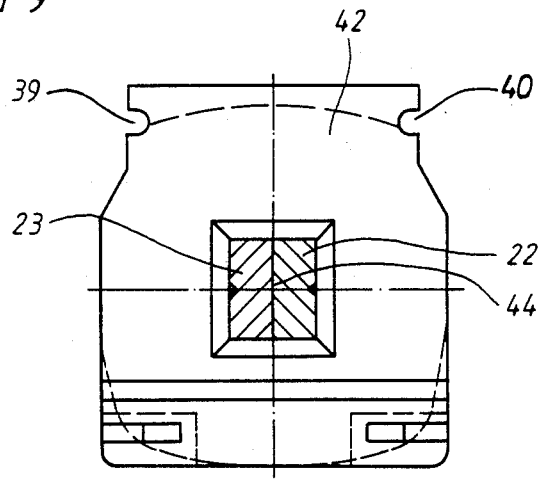
Figure 10:
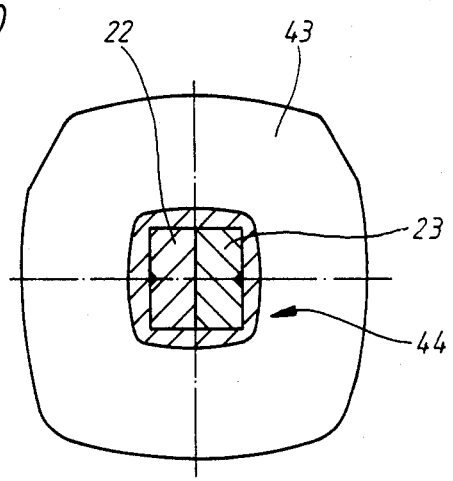

They show:

FIG. 1: side view of a relay according to the invention in disassembled presentation;

FIG. 2: side view of an anchor plate;

FIG. 3: over view of the anchor plate;

FIG. 4: rear view of a yoke;

FIG. 5: side view of a yoke;

FIG. 6: a side view rotated 90° of a yoke;

FIG. 7: front view of the spring jack;

FIG. 8: side view of the spring jack;

FIG. 9: front view of the exciter coil;

FIG. 10: front view of the opposite side of the exciter coil.

The anchor tumble switch 11 contains two anchor plates 24, 25 which between themselves accommodate the permanent magnet 12. An important feature is that the front surfaces of the anchor plates 24, 25 have a radius 26 (FIGS. 2 and 5). The radius has the advantage that despite exact leading in of the pole surfaces 27, 28 of the yokes 14, 15, due to existing inaccuracies, slight non-parallel shapes of these surfaces can exist, and are accommodated.

The anchor plates 24, 25 close the magnetic circle from one pole surface to the other, and therefore the anchor plates 24, 25 preferably lie linearly on the pole surfaces.

But, due to production tolerances, this will be realized only theoretically, and therefore a person will utilize a skirt-lined or even point shape impression of the anchor plates 24, 25 on the pole surfaces 27, 28. With this reduced bearing surface or even point shape bearing surface, symmetry faults will be greatly reduced.

The contact surfaces 29, 30 on the surfaces 27, 28 acting on the anchor plates 24, 25 are indicated in the region of the arrows. These same contact surfaces serve also the oppositely lying yoke 15.

Essential hereto is that through the shortening of the anchor plate length, depending on the front side radius 26, uniform bearing surface is guaranteed on the contact surfaces 29, 30, whereby the direction control of the magnetic line flow circle is reduced to a minimum. That is therefore certainly a larger loss factor, and one tolerates a larger magnetic resistance of the total magnetic circle, because with the increase of the magnetic resistance in the circle, a reduction of the symmetry faults is realized.

The pole surfaces 27, 28 of the yoke 14, 15 grip into the exit openings 31, 32 of the tumbler switch 11, these exit openings being positioned between the anchor plates 24, 25 in the assembly of the switch. Simple assemblage results therefrom, in that the notch bolt 13 of the tumbler switch 11 grips into the groove exit 7 of the spring jack 1 and in that, further, the coil 17 is squeezed onto the yokes 14, 15. The yokes 14, 15 grip with the pole surfaces 27, 28 into the conduit rabbet 47, 48 of the spring jack 1, whereby the notch noses **16*a*, 16*b*, arranged at the yoke in the region of the yoke plates 33, notch into the appropriate notch openings 10*a*, 10*b* of the spring jack 1**.

The notching of the bolt 13 of the tumbler switch 11 in the notch exit 7 of the spring jack 1, is achieved by the feature that the notch exit 7 is slightly cut at the back, and thereby a certain elasticity results. Further, the wall of the spring jack is weakened by a slot 8 in the region of the seat 6.

Each yoke 14, 15 includes, as indicated in FIGS. 4–6 respectively, a pole surface 27, 28 with under and upper contact surfaces 29, 30; further, the yoke includes a yoke plate 33 with side notch noses **16*a*, 16*b***.

In the exit opening 36 of the spring jack, the coil body of the exciter coil 17 is set, and at that place fastened with short conduit ribs 37, 38 against movement in axial direction. The conduit ribs 37, 38 grip into corresponding notch openings 39, 40, as shown in FIG. 9, at the coil flange 42. These notch openings 39, 40 are only at one coil flange 42, at the side where joined, while at the opposite coil flange 43 there are no notch openings provided. They can, however, also be provided at both coil flanges. The core shanks 22, 23 of the yoke 14, 15, previously described, grip into the core opening 44 of the exciter coil 17.

In yoke 14, 15 in the region of the yoke plate 33, there are spaced lateral plate conduit projections 45, 46 arranged at the yoke plate, and thereby is guaranteed a stability of the yoke plate 33 at the spring jack 1 in the region of the exit opening 36.

An important feature is that the rabbets 47, 48 extend the width of the spring jack. These rabbets 47, 48 are produced in the synthetic injection die casting of the spring jack with a single tool, so that the rabbets, by means of this tool, are exactly parallel.

The spring jack is universally interchangeable, and therefore the spring jack contact regulations are made applicable correspondingly thereto.

We claim:

1. A polarized electro magnetic relay having an assumed identifying positional attitude on which the following relations as based, the relay including a housing having a lower part in which the operating component parts are located and including a spring carrier conforming to the lower part of the housing, said component parts including, an energizer coil having end faces, yokes having yoke plates abutting said end faces, the yokes being identical and symmetrical and the end plates thereof extending vertically and parallel to each other at right angles to the axis of the energizer coil, the yoke plates having free ends bent toward each other at right angles to form pole faces, and a swivelling rocker armature with a permanent magnet positioned in the region of said pole faces, and the rocker armature having anchor plates capable of being brought into contact engagement with said pole faces of the yokes, characterized in that, the yokes have shanks positioned at right angles to the yoke plates extending into the energizer coil and having overlapping contact engagement with each other throughout the full length of the energizer coil, the spring carrier has opposite side elements between which said components are positioned, and the side elements having detents therein, and the rocker armature having lateral detent bolts engageable in said detents, the spring carrier has side grooves and the pole faces have side shoulders engaging in said grooves in response to insertion of the yokes into the housing.

2. A relay according to claim 1 wherein, the spring carrier has detent apertures in the side elements, and the yokes have laterally projecting elements operably engageable in said detent apertures to normally retain the yokes in the spring carrier.

3. A relay according to claim 1 wherein, the energizer coil has end flanges and at least one of which is provided with detent apertures on opposite edges of the flanges, and the spring carrier is provided with latch elements engaging in said detent apertures to normally retain the energizer coil against axial displacement.

* * * * *